US005871140A

United States Patent [19]

McCrink

[11] Patent Number: 5,871,140

[45] Date of Patent: *Feb. 16, 1999

[54] HOLLOW SHAFT AND METHOD OF MAKING SAME

[76] Inventor: Edward J. McCrink, P.O. Box 1429, Rancho Santa Fe, Calif. 92067

[ * ] Notice: This patent issued on a continued prosecution application filed under 37 CFR 1.53(d), and is subject to the twenty year patent term provisions of 35 U.S.C. 154(a)(2).

[21] Appl. No.: 400,235

[22] Filed: Mar. 3, 1995

Related U.S. Application Data

[63] Continuation-in-part of Ser. No. 106,585, Aug. 16, 1993, abandoned.

[51] Int. Cl.[6] ..... B23K 1/16; B23K 1/19; B23K 31/02

[52] U.S. Cl. ..... 228/132; 228/137; 228/150; 228/154; 228/262.42; 228/262.43; 148/529

[58] Field of Search ..... 228/137, 146, 228/150, 154, 147, 262.42, 126, 132, 262.43; 148/529

[56] References Cited

U.S. PATENT DOCUMENTS

| | | | |
|---|---|---|---|
| 1,670,639 | 5/1928 | Shipley et al. | 228/137 |
| 3,963,162 | 6/1976 | Taguchi et al. | 228/154 |
| 4,125,260 | 11/1978 | Kanne et al. | 273/80 R |
| 5,485,948 | 1/1996 | McCrink | 228/126 |

FOREIGN PATENT DOCUMENTS

| | | | |
|---|---|---|---|
| 1126828 | 4/1962 | Germany | 228/137 |
| 1-218793 | 8/1989 | Japan | 228/262.42 |

OTHER PUBLICATIONS

"Brazing of Stainless Steels," *Metals Handbook*, 9th Ed., 1983, pp. 1001–1013.

*Primary Examiner*—Patrick Ryan
*Assistant Examiner*—Jeffrey T. Knapp
*Attorney, Agent, or Firm*—Timothy J. King

[57] ABSTRACT

The invention provides methods of manufacturing stainless steel tubing, pipe and shafts by utilizing air hardenable stainless steel. Such pipe, tubing and shafts have the important characteristics of low weight, shaft flex, torque, bend point and strength and have many uses. The shafts include a plurality of air hardenable metal segments of selected length, thickness and shape that are assembled into a shaft. This assembly is subsequently contacted with a brazing material and then placed into a controlled, non-oxidative atmosphere furnace of a sufficient temperature such that the assembly is simultaneously brazed and hardened. The tubing can include having a brazed lock seam which provides strength. The present invention further provides reinforcing members that are also brazed within the shaft, tubing or pipe while the outer piece is hardened.

11 Claims, 3 Drawing Sheets

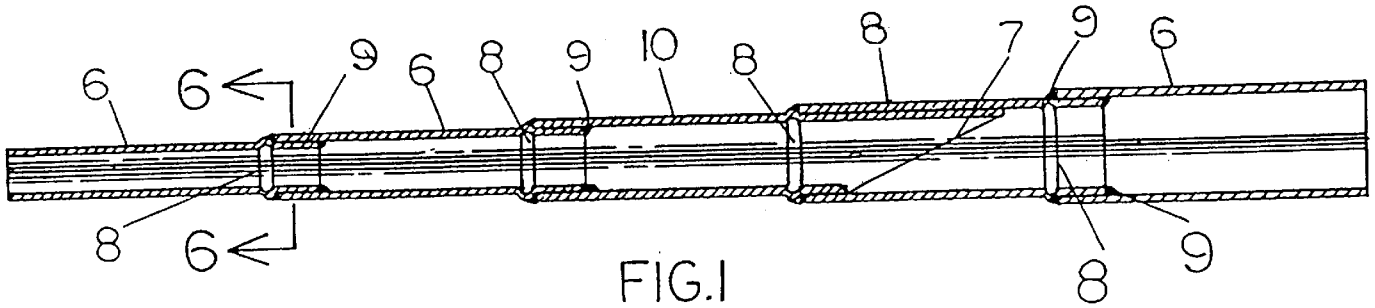
FIG.1
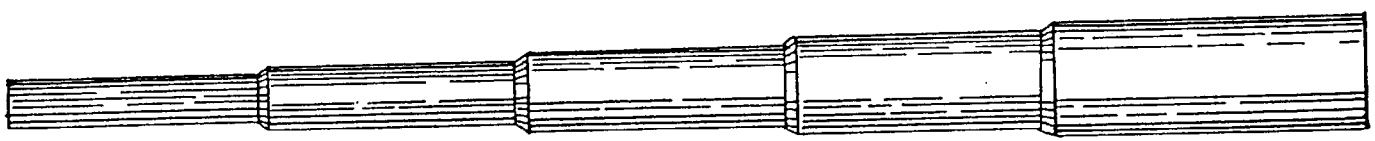
FIG.2
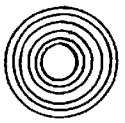
FIG.3
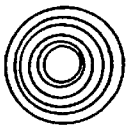
FIG.4
FIG.5

HOLLOW SHAFT AND METHOD OF MAKING SAME

This application is a continuation-in-part application of U.S. application Ser. No. 08/106,585, filed Aug. 16, 1993, for Shaft and Method of Making Same, now Abandoned.

BACKGROUND OF THE INVENTION

Hollow metallic shafts are ubiquitous in our society. They are used in products where lightness and strength are required. Products which utilize such hollow shafts include the more esoteric, such as sporting goods, to the more utilitarian, eg. cantilever street light poles and furniture of all types. With respect to sporting goods, they may be used for golf clubs, bicycle frames, ski poles or for the vertical supporting members of volleyball nets.

The materials presently used to construct hollow metallic shafts include the following: aluminum, low and high carbon steels, as well as stainless steels and coated steels, including, but not limited to galvanized steel, composites and graphite. However, these materials have limitations and may be objectionable for numerous reasons, including, but not limited to, weight, rigidity, flexibility and, in their use in sporting goods, torque resistance. What is needed is a hollow shaft which is light, strong and flexible.

Shafts which are presently used with sporting goods comprise metallic as well as composites and graphite materials. While composite and graphite shafts are light and are strong, they have minimal flexibility so they tend to snap. Aluminum is light, but lacks the strength of steel. Steel is usually too heavy and corrosive. Indeed, the increased use of composites and aluminum clearly suggest that the use of steel is inappropriate.

Lightness, strength, and flexibility are not the only characteristics that one desires in a hollow shaft used in a manner suggested above. An additional desirable characteristic would be if these shafts are corrosion resistant, thereby extending the lifetime of the products made with these shafts. Graphite, composites and stainless steels are all effective in their resistance to corrosion.

With respect to the steels, the use of alloy steels, in particular stainless steels, have been utilized in the manufacture of hollow shafts. The stainless steels comprise the ferritic, martensitic and austenitic structures. Of these, the austenitic stainless steel is the most widely used, this steel being characterized by its high nickel content and hence its being non-magnetic. The austenitic stainless steels are further characterized as essentially non-hardenable through the application of heat. Only martensitic stainless steel is hardenable by heat treating. Stainless had heretofore been the choice in many products where the use of a shaft that was light, flexible and strong. However, there was no ability to fashion the stainless steel to provide strength where needed, yet eliminate the weight where such strength was not needed. The present invention solves this problem.

With respect to the use of metal shafts for sporting goods, the prior art suggests numerous, but unsatisfactory, remedies of these problems: reinforcing tubular shafts with compressible tubular materials having a plurality of reentrant portions extending longitudinally and separated by longitudinally extending ribs, filling the hollow shaft with plastic materials or rubber, etc. The present invention provides an improved hollow shaft which can be crafted so as to provide the strength in the appropriate locations, whether the shaft is to be load bearing or used to strike a projectile.

BACKGROUND ART

There are a number of references which concern metallic shafts, yet none of which suggest the present invention: U.S. Pat. No. 1,944,069 describes a tubular metallic shaft closely simulating the wooden shaft used on a golf club that is reinforced within the tube by a convoluted material having reentrant portions extending longitudinally therefrom and separated by longitudinal ribs. U.S. Pat. No. 1,950,342 describes a hollow tubing metallic "steel" shaft with a core of sponge rubber. U.S. Pat. No. 3,762,707 describes the use of a material of a predetermined flexibility to a shaft which is used for a golf club. In addition, the interior of the shaft is partially filled from the point of attachment to the golf club head with a flexible plastic material. This plastic material is present within the tube from the point of attachment to a predetermined point.

BRIEF DESCRIPTION OF THE DRAWINGS

FIG. 1 provides a plan view of the brazed shaft.

FIG. 2 provides a side view of the brazed shaft.

FIG. 3 provides a left end view of the brazed shaft.

FIG. 4 provides a right end view of the brazed shaft.

FIG. 5 provides sectional view through 6—6 of FIG. 1.

SUMMARY OF THE INVENTION

Figure 6:
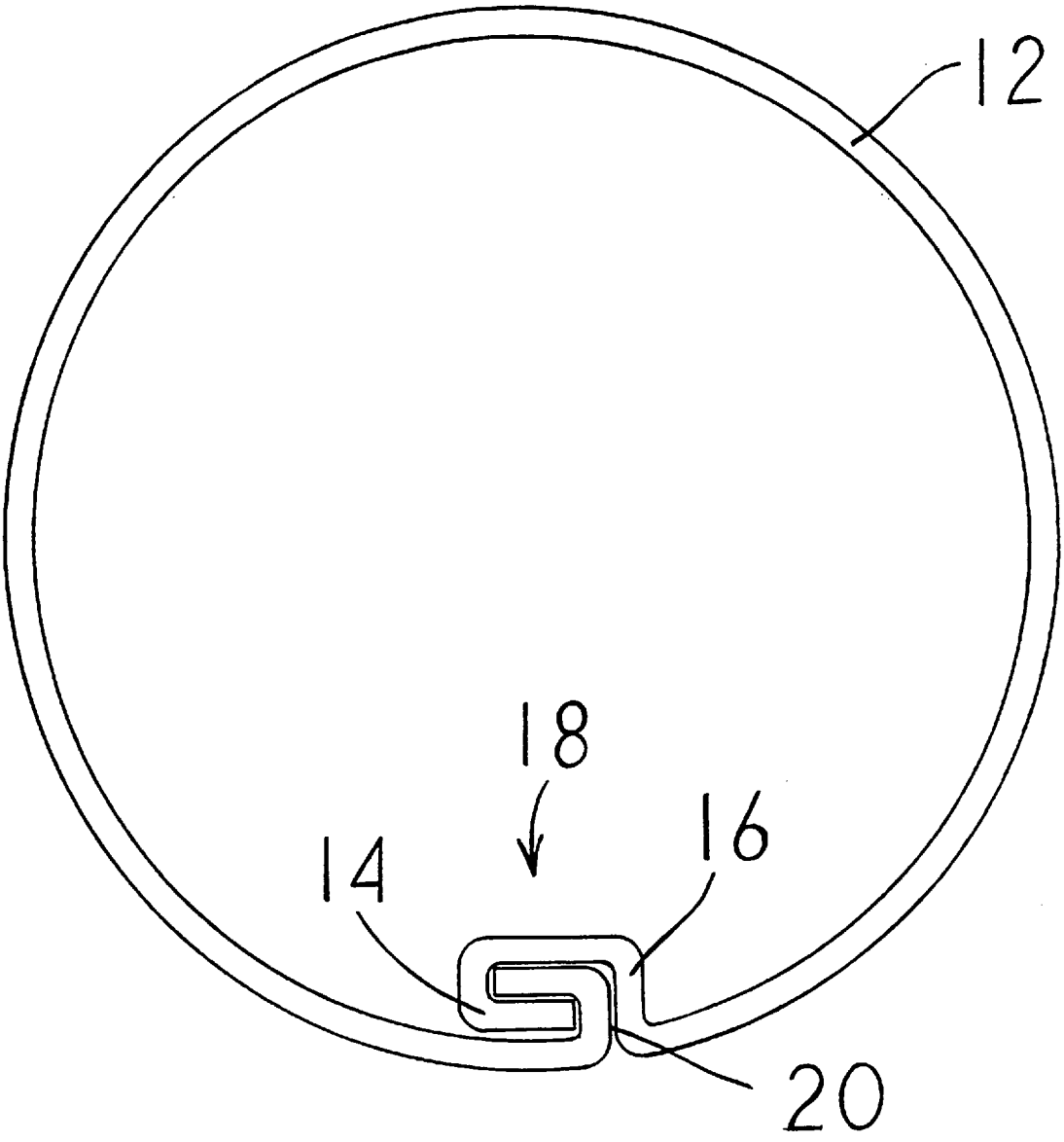
FIG. 6 provides an end view of stainless steel tubing with a brazed lock seam.

The present invention provides a method of making a hollow stainless steel shaft from an assembly of stainless steel tubing segments and a brazing material comprising the steps of utilizing stainless steel tubing segments of which at least one segment consists of a hardenable stainless steel, each segment having a first and a second end; assembling a plurality of the tubing segments such that the first end of one segment is fixed to the second end of an adjacent segment; introducing the brazing material at the confluence of adjacent segments; introducing the assembly into a controlled atmosphere or vacuum furnace; and brazing and hardening the assembly to form a rigid shaft.

The present invention further provides a method for producing hardened stainless steel tubing from an assembly of annealed hardenable stainless steel sheet and a brazing material, the method comprising the steps of selecting a hardenable stainless steel sheet capable of being transformed into tubing, the sheet characterized by a leading edge, two joining edges, a following edge, a top and a bottom; folding a portion of each of the joining edges, one edge being folded such that the folded portion is adjacent the top while the other edge is folded such that the folded portion is adjacent the bottom; rolling the sheet in such a manner that it becomes tube-shaped; clasping the folded portions of the joining edges to form a lock seam; contacting the brazing material with the lock seam; introducing the assembly into a controlled atmosphere or vacuum furnace; and brazing and hardening the assembly to form hardened stainless steel tubing.

The present invention also provides a method for producing reinforced hardened stainless steel tubing from an assembly of stainless steel stock and a brazing material, the method comprising the steps of selecting an air hardenable stainless steel tubing of a predetermined diameter; introducing within the tubing a stainless steel member having a first and second surface, the second surface substantially in contact with the internal surface of the tubing; contacting at least one confluence of the tubing and the member with a brazing material; introducing the assembly into a controlled atmosphere furnace; and brazing and hardening the assembly to form hardened and reinforced stainless steel tubing.

The present invention further provides the stainless steel shafts and tubing produced by the methods disclosed herewith.

DETAILED DESCRIPTION OF THE INVENTION

The present invention provides a method of manufacturing hollow hardenable stainless steel shafts, tubing and pipe. The present invention further provides the reinforcement of such shafts, tubing or pipe. One embodiment of the present invention is directed to the method of manufacturing golf shafts, wherein the important characteristics such as weight, shaft flex, torque, bend point and strength can be precisely tailored to provide a golf club that is greatly improved because it is light and has the strength and flex where appropriate.

The golf club shaft may be assembled from a plurality of tubular segments having one end that is tapered, and the segments having decreasing diameters so as to provide a segmented shaft of decreased diameter from the handle to the club attachment point. This particular embodiment could be produced from straight segments or segments which are only tapered. The assembled shaft would have at least one segment that was made from an air hardenable stainless steel, such as 410 stainless steel. It is also possible to make the shafts from any martensitic stainless steel. The members which are used to reinforce stainless steel tubing, pipe and shafts may be made from any of the hardenable stainless steels or from any one of the austenitic stainless steels if ductility is desired. The reinforcing member may also consist of a hardenable stainless steel. The assembled segments are heated in a controlled atmosphere furnace, with brazing material applied to the joining surfaces of the segments. For purposes of this application, "controlled atmosphere furnace" means a furnace wherein an atmosphere which prevents oxidation is provided. Such an atmosphere includes no atmosphere, that is, a vacuum. It also includes a hydrogen atmosphere. In one embodiment, a hydrogen atmosphere is fed into a hump furnace. The assembly is heated to the proper temperature, whereby the assembly is brazed and hardened automatically. In a preferred embodiment the assembly is brazed and hardened simultaneously. The temperature range appropriate for simultaneously brazing and hardening stainless steel is 1900–2000 degrees F.

The tubular segments can be varied in shape from straight portions with flat ends to elongated narrow or pointed, bias cut, portions. The thickness of the segments may be as thin as 0.005 inches.

This method of brazing eliminates the need of a brazing flux and provides a metallurgically strong joint. Other metals, and alloys of metals, that will braze and harden in a controlled atmosphere furnace can be used in this method for manufacturing golf club shafts, shafts for ski poles, bicycle frames, street light poles, furniture and other applications.

The present invention provides hollow shafts composed of segments of air hardenable stainless steel, the use of such segments allowing for the selection of the appropriate thickness and length of each particular segment. Strength is maximized in the segment by overlapping where it is necessary and thinner segments may be selected where strength is not needed, thereby lessening the weight of the shaft. The shaft segments may be tapered or straight, or have different diameters, to provide the suitable strength and weight needed for the application.

A further embodiment of the present invention includes cleaning all segments by vapor degreasing or some equivalent method, assembling the segments for a shaft of a pre-determined length; contacting the brazing material with the assembled shaft, heating the furnace to a temperature suitable for simultaneously brazing and heat treating the shaft assembly, and cooling the shaft assembly in the proper atmospheric environment to deter oxidation. The present invention provides that contacting the brazing material with the assembled staff may require placing brazing material at the confluence of adjacent segments of the pre-brazed shaft.

The present invention provides a method for producing hardened stainless steel tubing from an assembly of a heat treatable hardenable stainless steel sheet and a brazing material, the method comprising selecting a hardenable stainless steel sheet capable of being transformed into tubing, the sheet characterized by a leading edge, two joining edges, a following edge, a top and a bottom; folding a portion of each of the joining edges; rolling the sheet in such a manner that it becomes tube-shaped; arranging the folded portions of the joining edges to form a lock seam; contacting the brazing material with the lock seam; introducing the assembly into a controlled atmosphere furnace; and brazing and hardening the assembly to form hardened stainless steel tubing. In a preferred embodiment the method further comprises heating the furnace to a temperature suitable for simultaneously brazing and hardening the assembly. The present invention further provides hardened stainless steel tubing comprising a brazed lock seam; the tubing produced by the method set forth hereinabove.

The present invention further provides a method for producing reinforced hardened stainless steel tubing from an assembly of stainless steel stock, a metal member and a brazing material, the method comprising selecting an air hardenable stainless steel tubing of a predetermined diameter; introducing within the tubing a metal member having a first and second surface, the second surface substantially in contact with the internal surface of the tubing; contacting at least one confluence of the tubing and the member with a brazing material; introducing the assembly into a controlled atmosphere furnace; and brazing and hardening the assembly to form hardened and reinforced stainless steel tubing. In a preferred embodiment the method further comprises heating the furnace to a temperature suitable for simultaneously brazing and hardening the assembly. In a further preferred embodiment of the invention, the stainless steel tubing used to make the reinforced and hardened tubing comprises a lock seam.

In a preferred embodiment of the invention the method further comprises contacting the lock seam with a brazing material prior to introducing the assembly into the controlled atmosphere furnace. In an additional embodiment of the invention, the metal member utilized in the method is a bushing having an outside diameter equal or less than the internal diameter of the tubing it is inserted into. It is contemplated that the bushing will have an interference fit with the tubing in which it is placed. In a further embodiment of the invention, the metal bushing is further characterized by having a portion thereof cut away. The metal member may be composed of any metal, but in a preferred embodiment it is comprised of stainless steel. In a further embodiment of the invention, the metal member comprises an austenitic steel so as to provide ductility to the reinforced hardened stainless steel tubing.

The present invention further provides reinforced hardened stainless steel tubing comprising a first hardened stainless steel tube; and a metal member, a surface of the member brazed to the first stainless steel tube to strengthen it; the tubing produced by the method set forth hereinabove.

Referring to FIG. 1, the sectional view of a hollow tapered shaft shows the telescoping segments 6 brazed at their joining surfaces at 9. Segment 10 is made from 0.010 inch stainless steel with a bias end 7. Segments may have a circumferential ring 8 to ensure proper location of the segments when assembled, yet this is not an essential element of the invention. Segments need not be telescoping. The thickness of the segments and the amount and shape of overlap provide tailoring of the completed shaft for strength, flexibility and stiffness, which may be accomplished by a variety of ways. First, the thickness of individual segments may be varied. Indeed, the segment material may be as thin as 0.005 inches. Second, the amount of overlap of adjacent segments may be varied to provide additional strength when needed. A further embodiment of tailoring the shaft is tapering the overlap of the adjacent segments, as set forth in 7 of FIG. 1. A further embodiment of tailoring the completed shaft is altering the shape of overlap, e.g., semi-elliptical, rhombic, semicircular, to distribute the stresses on the particular joint. Nonuniform segment shapes are also contemplated by the invention.

Referring to FIG. 6, the end view of the hollow metal tubing provides the tubing wall 12, the joining edges 14 and 16 folded so as to form a lock seam 18. In between the folded edges 14 and 16 is the solidified brazing material 20. The joining edges may be folded in a variety of ways to form the lock seam, and such ways are known to those of skill in the art.

Figure 7:
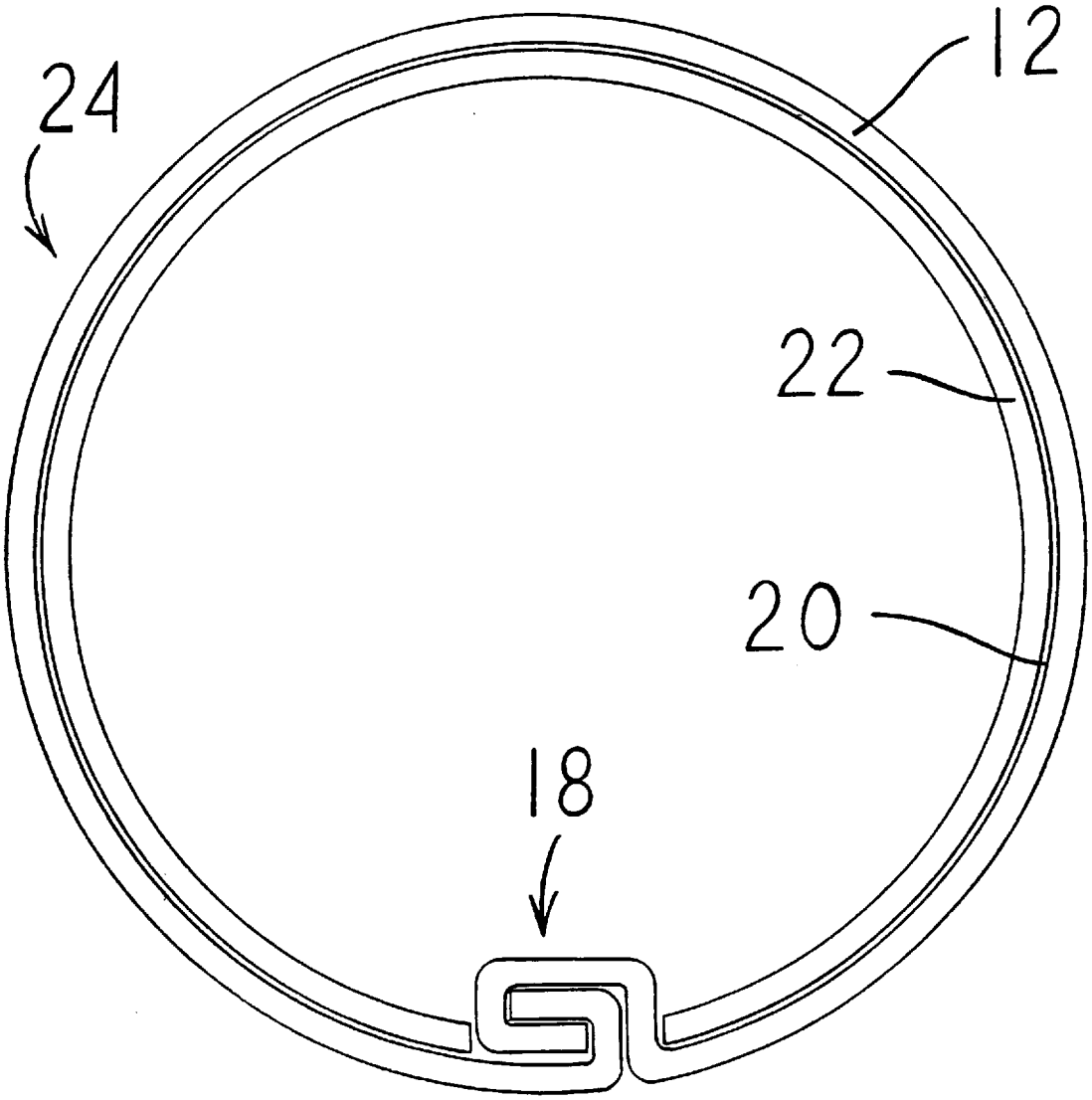
FIG. 7 provides an end view of the stainless steel tubing segment with a brazed lock seam and split bushing.

Referring to FIG. 7, the end view of the reinforced hollow metal tubing provides the tubing wall 12, the joining edges 14 and 16 folded so as to form a lock seam 18. In between the folded edges 14 and 16 is the solidified brazing material 20. FIG. 7 further provides a split bushing 22 which is brazed to the tubing 24. Where the hardenable stainless steel tubing utilized to produce the present invention does not have a brazed lock seam, a non-split bushing may be used, unless the particular application required strength on only one side of the tube. In such a circumstance, it's appropriate to introduce a split bushing, strip, or rods, eg, which would be brazed into the tubing. Moreover, as with the tapered shaft, predesigned inserts of a variety of shapes is contemplated for the present invention, said metal members fashioned according to the specific strength and weight characteristics desired for the particular application.

What is claimed is:

1. A method of making a hollow stainless steel shaft from an assembly of stainless steel tubing segments and a brazing material comprising:

utilizing stainless steel tubing segments of which at least one segment consists of a heat-treatable hardenable stainless steel and at least one segment is not, each segment having a first and a second end;

assembling a plurality of the tubing segments such that the first end of one segment is fixed to the second end of an adjacent segment;

introducing the brazing material at the confluence of adjacent segments;

introducing the assembly into a controlled atmosphere furnace; and brazing and hardening the assembly to form a rigid shaft.

2. The method of claim 1, wherein each segment has a circumferential bead at the first end which extends inside the second end of the adjacent segment.

3. The method of claim 1 further comprising:

heating the furnace to a temperature suitable for simultaneously brazing and hardening the assembly.

4. The method of claim 1 further comprising:

cleaning all segments prior to assembly;

assembling the segments for a shaft of a predetermined length;

heating the furnace to a temperature suitable for simultaneously brazing and hardening the assembly; and cooling the brazed and hardened shaft assembly in the proper atmospheric environment to deter oxidation.

5. A method for producing reinforced hardened stainless steel tubing from an assembly of stainless steel stock, a metal member and a brazing material, the method comprising selecting an air hardenable stainless steel tubing of a predetermined diameter;

introducing within the tubing a metal member having a first and second surface, the second surface substantially in contact with the internal surface of the tubing;

contacting at least one confluence of the tubing and the member with a brazing material;

introducing the assembly into a controlled atmosphere furnace; and brazing and hardening the assembly to form hardened and reinforced stainless steel tubing.

6. The method of claim 5 further comprising:

heating the furnace to a temperature suitable for simultaneously brazing and hardening the assembly.

7. The method of claim 5, wherein the metal member comprises stainless steel.

8. The method of claim 5, wherein the stainless steel tubing comprises a lock seam.

9. The method of claim 8 further comprising:

contacting the lock seam with a brazing material prior to introducing the assembly into the controlled atmosphere furnace.

10. The method of claim 5, wherein the metal member is a bushing having an outside diameter equal or less than the internal diameter of the tubing it is inserted into.

11. The method of claim 10, wherein the metal bushing is further characterized by having a portion thereof cut away.

* * * * *